United States Patent [19]

Miles et al.

[11] Patent Number: 4,561,949

[45] Date of Patent: Dec. 31, 1985

[54] APPARATUS AND METHOD FOR PREVENTING ACTIVITY LOSS FROM ELECTRODES DURING SHUTDOWN

[75] Inventors: Ronald C. Miles; David D. Justice, both of Cleveland, Tenn.

[73] Assignee: Olin Corporation, Cheshire, Conn.

[21] Appl. No.: 526,936

[22] Filed: Aug. 29, 1983

[51] Int. Cl.[4] ..... C23F 13/00

[52] U.S. Cl. ..... 204/147; 204/98; 204/196; 204/228; 204/252; 204/253

[58] Field of Search ..... 204/147, 196, 98, 231, 204/290 R, 228, 252

[56] References Cited

U.S. PATENT DOCUMENTS

| | | | |
|---|---|---|---|
| 2,257,385 | 9/1941 | Keegan | 204/196 |
| 2,508,523 | 5/1950 | Krebs | 204/196 |
| 2,575,712 | 10/1951 | Jernstedt | 204/228 |
| 2,759,887 | 8/1956 | Miles | 204/196 |
| 2,834,728 | 5/1958 | Gallone | 204/147 |
| 4,147,608 | 4/1979 | Stevens | 204/196 |
| 4,169,775 | 10/1979 | Kuo | 204/98 |
| 4,333,804 | 6/1982 | Saito et al. | 204/98 |
| 4,358,353 | 11/1982 | Bommaraju et al. | 204/98 |
| 4,364,806 | 12/1982 | Rogers | 204/98 |
| 4,370,530 | 1/1983 | Wayland | 204/98 |
| 4,390,763 | 6/1983 | Hruda | 204/279 |
| 4,421,614 | 12/1983 | Yamaguchi et al. | 204/228 |

FOREIGN PATENT DOCUMENTS

| | | | |
|---|---|---|---|
| 149295 | 12/1977 | Japan . | |
| 56-52397 | 10/1982 | Japan | 204/147 |
| 169096 | 10/1982 | Japan . | |

*Primary Examiner*—Andrew H. Metz
*Assistant Examiner*—Terryence Chapman
*Attorney, Agent, or Firm*—James B. Haglind; Donald F. Clements

[57] ABSTRACT

An improved method for shutting down an electrolytic cell for the electrolysis of aqueous solutions containing ionizable compounds is provided. The electrolytic cell has a first electrode, a second electrode of opposite polarity, a first conductor electrically connected to the first electrode and a second conductor electrically connected to the second conductor, and means for supplying an electric current to the first and second conductors. The method improvement comprises activating a cell protection circuit between the first conductor and the first electrode, and preventing the passage of reverse currents through the cell.

The method can also be employed to prevent the passage of reverse currents through a plurality of cells in series in the case of a power outage or disruption.

16 Claims, 2 Drawing Figures

APPARATUS AND METHOD FOR PREVENTING ACTIVITY LOSS FROM ELECTRODES DURING SHUTDOWN

This invention relates to electrochemical cells and more particularly to the prevention of loss of activity of catalytically coated electrodes during cell shutdown periods.

The employment of electrodes having catalytically active coatings, for example, in electrochemical cells for the production of chlorine and alkali metal hydroxides or oxygen and hydrogen has resulted in the finding that these electrodes lost activity during periods when the electric current is not fed through the cell.

A variety of solutions for this problem have been proposed. For example, in U.S. Pat. No. 4,169,775, issued Oct. 2, 1979, to H. C. Kuo, the cell is provided with an auxiliary circuit to supply a DC cathodic protection current of low density to the cathode during periods when the cell is not in operation. To provide the DC current, the DC power source includes a switch, a diode, a battery and a rheostat connected in series. The circuit is open during normal cell operation, but is closed immediately after any power loss is noted in the cell circuit.

Japanese Patent Disclosure No. 1982-169,096 published Oct. 18, 1982, by S. Matuura et al teaches the protection of electrolysis cells using ion exchange membranes by employing a minimal current below the decomposition voltage during a period when the cell is not in use.

U.S. Pat. No. 4,333,804, issued June 8, 1982, to K. Saito et al describes a method for protecting palladium oxide anodes during periods of cell shutdown by the addition of hypochlorite ions to the anode compartment during the shutdown period. The addition of the hypochlorite ions increases the anode potential to a level which is higher than the reduction potential of palladium oxide.

Cathodes of a transition metal such as nickel are protected during periods when the current flow to the cell is interrupted by the addition of a reducing agent such as sodium sulfite or urea to the cathode compartment. In this method, as described in U.S. Pat. No. 4,358,353, issued Nov. 9, 1982, to T. V. Bommaraju et al, the reducing agent reacts with any sodium hypochlorite present in the electrolytic solution in the cathode compartment to prevent the deterioration of the transition metal in the cathode or cathode coating.

U.S. Pat. No. 4,364,806, issued Dec. 21, 1982, to D. K. Rogers teaches a shutdown procedure for cells employing gas electrodes such as oxygen and air cathodes which includes imposing a nitrogen purge on the cell containing the electrode during power shutdowns.

Now it has been found that an electrolytic cell can be protected during shutdown periods without maintaining residual currents requiring additional electrical apparatus such as batteries or diodes or by the addition of gases or liquids to the electrode compartments.

It is an object of the present invention to povide an improved method for shutting down electrolytic cells for the electrolysis of aqueous solutions which prevents loss of activity of electrodes when the cell is not in operation.

Another object of the present invention is to provide an improved method for shutting down electrolytic cells for the electrolysis of aqueous solutions having reduced apparatus and maintenance costs.

A further object of the present invention is to provide apparatus for effectively shutting down electrolytic cells for the electrolysis of aqueous solutions which prevents damage to electrolytic cell components.

The objects of the invention are accomplished in a method for shutting down an electrolytic cell for the electrolysis of aqueous solutions containing ionizable compounds having a first electrode, a second electrode of opposite polarity, a first conductor electrically connected to the first electrode and a second conductor electrically connected to the second electrode, means for supplying an electric current to the first and second conductors, characterized by the method improvement which comprises activating a cell protection circuit between the first conductor and the first electrode during cell shutdown to prevent the passage of reverse currents through the cell.

The novel method of the present invention is carried out in an improved electrolytic cell having a cell body comprised of a first electrode, a second electrode of opposite polarity, and a separator between the first electrode and the second electrode, a first conductor connected to a first electrode, a second conductor connected to a second electrode wherein the improvement comprises a cell protecting switch connected to the first conductor and the first electrode.

Other advantages of the invention will become apparent upon reading the description below and the invention will be better understood by reference to the attached FIGURES.

BRIEF DESCRIPTION OF THE DRAWINGS

FIG. 1 is a schematic representation of an electrolytic cell having an electrical shunting switch assembly and the cell protective switch of the present invention connected across the cell. In FIG. 1, electrolytic cell 10 is an electrolytic cell having an anode terminal 12 and a cathode terminal 14. Electrolytic cell 10 is normally one of a plurality of cells connected in series, as shown in FIG. 2, which operates at a relatively constant current produced by a DC power supply. Cell terminals 12 and 14 are connected to plant load line 40 which is by way of example a line which carries about a 150 KA current load for the system. Electrolytic cell 10 has an internal resistance value of RC and an open-circuit potential of about 2.3 volts which appears across the anode and cathode terminals when the cell is not carrying current. Electrical shunting switch 16 is connected in electrical parallel relationship across anode and cathode terminals 12 and 14 respectively. The shunting switch assembly 16 comprises, for example, a plurality of vacuum switches S1, S2, S3, and SN disposed in electrically parallel path relationship with the corresponding series resistance values R1, R2, R3 and RN in the individual parallel branch paths. The exact number of parallel paths and vacuum switches SN in the switch assembly is largely determined by the plant current load with the higher the current, in general, the greater the number of paths and switches. Thus for a plant with a current load of 150 KA, there may be 36 paths and switches. The resistance values of R1, R2, R3 and RN are determined so as to develop sufficient IR potential drop across the current carrying switch assembly so that compared to the electrolytic cell potential there will be diversion of an increased proportion of the current from the switch assembly back through the cell when the potential across the switch assembly exceeds the cell electrolyzing potential. The resistance value is typically provided by the bus conductor leads which are dimensioned to give the desired branch path resistance value. While such bus conductors are typically copper, a stainless steel bus conductor may be used to provide the desired resistance value. A physical resistor may also be used.

The plurality of separate parallel paths of switches and resistor values are connected to electrical bus leads 18 and 20, which are connectable respectively to the cell anode and cathode terminals 12 and 14. Each individual vacuum switch SN is controlled and operated by an air cylinder AC1, AC2, AC3, and ACN, respectively. The inner cylinders ACN are connected via respective link means 22, 24, 26 and 28, which effectuate axial movement of the switch contacts for opening and closing the switch contacts. The air cylinders ACN are controlled from a master controller 30 which asynchronously actuates the air cylinders to operate the individual vacuum switches at predetermined timed intervals. Other types of vacuum switch actuators including electrical solenoids can be used.

Figure 1:
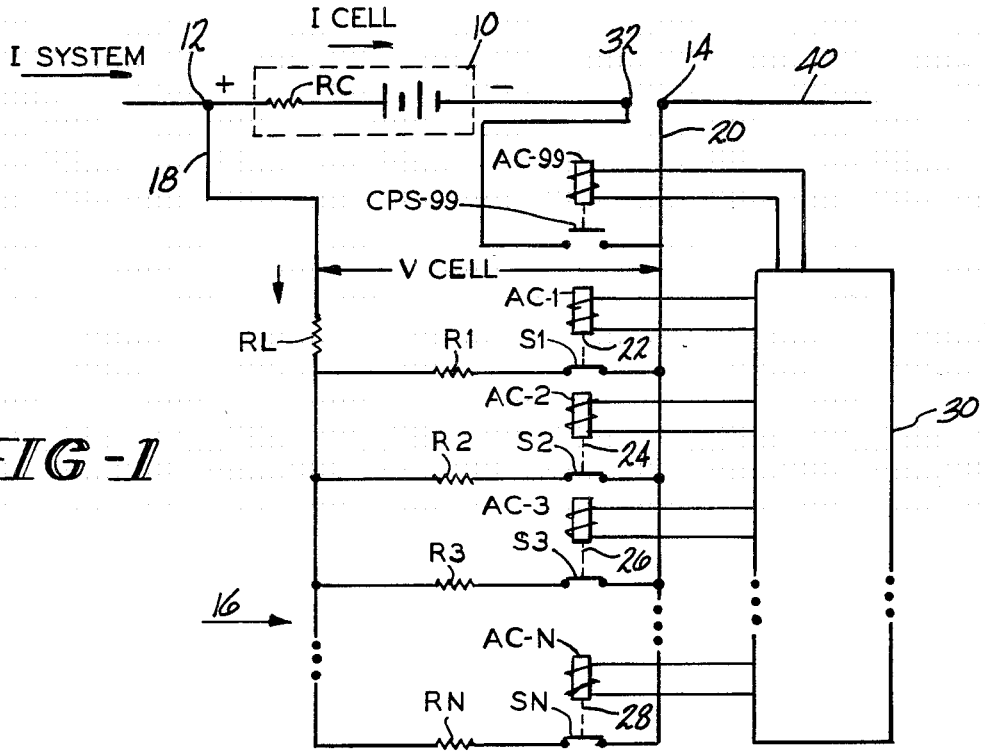
FIG. 1 is a schematic representation of an electrolytic cell having an electrical shunting switch assembly in association with the cell protective circuit of the present invention.

In one embodiment of the method of the present invention during normal operation of the cell when electrolysis is being conducted, shunt switches S1, S2, S3 and SN remain open while cell protection switch 99 remains closed. In shutting down the cell, shunt switches S1, S2, S3 through SN are systematically closed. When the current is reduced to a suitable level, cell protection switch 99 is opened and the remaining shunt switches closed to discontinue flow of electric current through electrolytic cell 10, as illustrated in FIG. 1. This novel method prevents the passage of reverse discharge currents from the cathode to the anode and prevents loss of activity of the electrodes upon startup as well as preventing damage to the other cell components, including ion exchange membranes during the shutdown period.

Upon cell startup, shunt switches S1, S2, S3 through SN are systematically opened and when the voltage gets to a suitable level, cell protection switch 99 is closed and the remainder of the shunt switches are opened.

Figure 2:
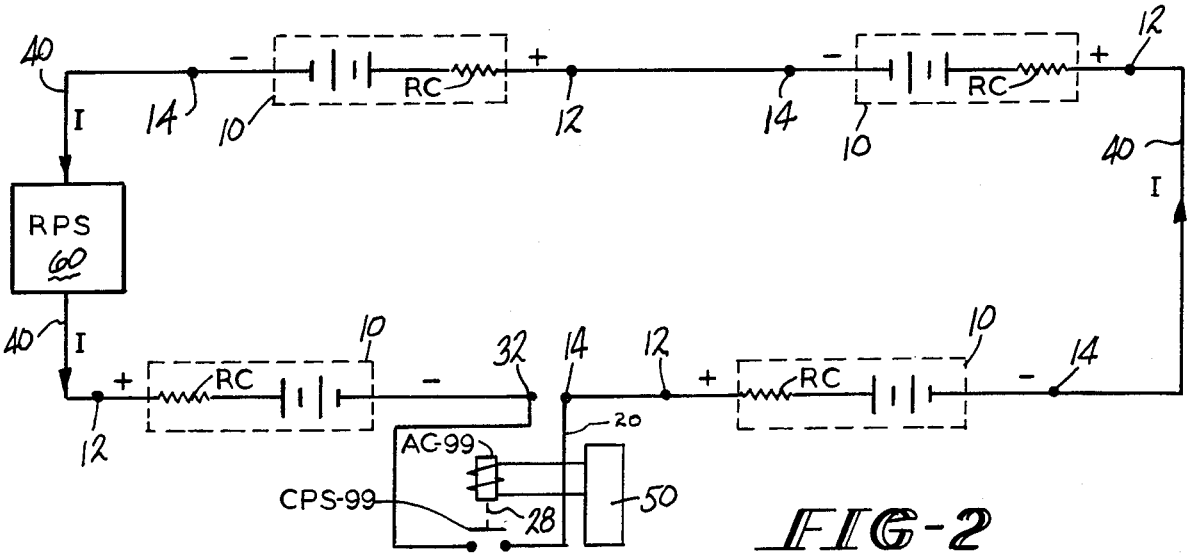
FIG. 2 is a schematic representation of a cell room containing a plurality of electrolytic cells in series and employing the cell protective circuit of the present invention.

FIG. 2 is a schematic representation of a cell room containing a plurality of electrolytic cells in series. D.C. current normally flows from rectifier power supply 60 through power line 40 to anode terminal 12 of electrolytic cell 10, through electrolytic cell 10 to terminal 32, through protection switch 99, to cathode terminal 14 and then to anode terminal 12 of electrolytic cell 10. Current flows through the other cells in the series before returning to rectifier power supply 60. Cell protection switch 99 is normally closed. Should, however, the cell room suffer a power disruption, control 50 immediately opens cell protection switch 99 by activating air cylinder 99 and damage to the cell components by reverse currents is prevented.

Cell protection switch 99 is any suitable heavy duty switch capable of carrying the cell current. Suitable switches include single pole, double pole, or multiple pole switches, with double pole and multiple pole switches being preferred. Cell protection switch 99 is connected to cathode terminal 14 via bus connector 20 and terminal 32, for example, by bolting the switch to the buswork. Cell protection switch is operated, for example, by air cylinder 99 and controlled from master controller 30 or control 50.

As shown in FIG. 2, cell protection switch 99 may be installed permanently in the cell line to prevent the passage of reverse discharge currents through the cells, for example, when unplanned for power shortages or power outages occur.

In another embodiment, cell protection switch 99 is a portable unit which is used in association with a shunting switch such as shunting switch assembly 16 illustrated in FIG. 1. The cell protection switch may be independent of or combined with the shunting switch.

Any suitable portable shunting switch assembly may be employed as shunting switch 16. A preferred embodiment is that described in U.S. Pat. No. 4,370,530 issued Jan. 25, 1983, to P. O. Wayland. The entire disclosure of this patent is hereby incorporated by reference.

While FIG. 1 shows cell protection switch 99 connected to terminals 14 and 32 on the cathode side of the cell, equally suitable results are obtained by connecting cell protection switch 99 to terminals 12 and another suitable terminal on the anode side of cell 10.

While the cell protection switch can handle the operating cell current, it is preferred, particularly for electrolytic cells employing cation exchange membranes as separators, to reduce the current load before activating the cell protection switch. The current reduction may be to any suitable level down to that current which is slightly above that employed at the reversible potential, which for electrolytic cells producing a halogen gas such as chlorine and an alkali metal hydroxide is about 2.3 volts. The current reduction may be carried out, for example, using the shunting switch assembly or through the rectifier power supply.

The method and apparatus of the present invention are effective in preventing reverse discharge currents from passing through the cell whether the cell is shutdown for a short period or an extensive period of time. Further, short circuiting or "shorting" out the cell which is routinely practiced in shutting down electrolytic cells, is avoided by the method and apparatus of the present invention. Without wishing to be bound by theory, it is believed that reactive species such as ions and gases remaining in the cell after it shut down are prevented from causing damage to cell components by the absence of a current path which results when the cell protection circuit of the present invention is employed.

Electrolytic cells in which the cell protection method and apparatus of the present invention may be used include those which are employed in the production of halogens, alkali metal hydroxides, and alkali metal halates by the electrolysis of alkali metal halide brines. Protection may also be provided for electrolytic cells employed in the commercial production of oxygen and hydrogen gases by the electrolysis of aqueous solutions containing an electrolyte such as an alkali metal hydroxide. Preferred electrolytic cells are those used in the electrolysis of alkali metal halide brines including sodium and potassium chloride or sodium and potassium bromide.

While the cell protection method and apparatus may be beneficially employed in electrolytic cells having a wide variety of electrode materials, it is particularly useful for electrolytic cells employing, for example, low halogen overvoltage anodes and low hydrogen overvoltage cathodes.

Commercially available anodes for use in, for example, chlor-alkali or water electrolysis electrolytic cells may be used in electrolytic cells employing the method and apparatus of the present invention. These include anodes of graphite or a foraminous valve metal such as titanium or tantalum having an electrochemically active coating over at least a portion of the anode surface. Suitable coatings include those of a platinum group metal, platinum group metal oxide, an alloy of a platinum group metal or mixtures thereof. The term "platinum group metal" means an element of the group consisting of ruthenium, rhodium, platinum, palladium, osmium and irridium. Coatings containing mixtures of valve metal oxides such as titanium oxides and platinum group metal oxides such as ruthenium oxide are described in U.S. Pat. No. 3,632,498 issued to H. B. Beer on Jan. 4, 1972. Other anodes which may be employed include those described in U.S. Pat. Nos. 4,333,805, issued June 8, 1982, to C. R. Davidson et al; 4,240,887, issued Dec. 23, 1980, to D. E. Hall; 4,200,515, issued April 29, 1980, to D. E. Hall et al; 4,042,484, issued Aug. 16, 1977, to G. Thiele et al; 3,962,068, issued June 8, 1976, to D. Zoellner et al; and 3,992,280, issued Nov. 16, 1976, to C. Zoellner et al.

Suitable cathodes include as electrode structures a metal screen, mesh, perforated plate or expanded metal. The cathodes have at least one catalytically active surface including, for example, porous surfaces such as those of a Raney metal (e.g. nickel or cobalt) or permeable catalytic electrodes such as those having cathode catalyst materials attached to or imbedded in the membrane or incorporated in a polymer matrix. Cathodes which can be employed in the novel cell of the present invention include those, for example, described in U.S. Pat. No. 4,116,804, issued Sept. 26, 1978, to C. Needes; 4,184,941, issued Jan. 28, 1980, to W. W. Carlin; 4,248,680, issued Feb. 3, 1981, to W. W. Carlin et al; 4,135,995, issued June 23, 1979, to C. N. Welch; 4,224,121, issued Sept. 23, 1980, to R. W. Dempsey et al; and 4,033,837, issued July 5, 1977, to H. C. Kuo et al.

One preferred cathode embodiment comprises a Raney metal alloy surface layer integral with and derived from a selected nickel alloy monolithic substrate structure. The surface layer is predominantly derived from an adherent crystalline precursor outer portion thereon comprising $Ni_xM_{1-x}Al_3$ Beta phase structure where M is a catalytic activator and where x, the fraction of nickel in the combined weight of Ni and M, is up to about 0.95.

As the catalytic activator, M is preferably molybdenum. However, it should be understood that the use of molybdenum is merely illustrative and that it may be replaced in whole or in part by ruthenium, titanium, tantalum, or mixtures thereof. X is preferably within the range of 0.80 to about 0.95. The cathodes are disclosed by T. J. Gray in U.S. Pat. No. 4,240,895, issued Dec. 23, 1980, which is incorporated herein in its entirety by reference.

Other suitable cathodes include highly porous reticulate cathodes comprised of electroconductive filaments and having a means of applying an electrical potential to the filaments. The term "filaments" includes fiber, threads or fibrils. The filaments may be those of the electroconductive metals themselves, for example, nickel, titanium, platinum, or steel, or of materials which can be coated with an electroconductive metal. Any materials which can be coated with these electroconductive metals may be used including, for example, metals such as silver, titanium, or copper, plastics such as polyarylene sulfides, polyolefins produced from olefins having 2 to about 6 carbon atoms and their chloro- and fluoro- derivatives, nylon, melamine resins, acrylonitrile-butadiene-styrene (ABS) copolymers, and mixtures thereof.

Where the filaments can be coated and are nonconductive to electricity, it may be necessary to sensitize the filaments by applying a metal such as silver, nickel, aluminum, palladium or their alloys by known procedures. The electroconductive metals are then deposited on the sensitized filaments.

Suitable reticulate electrodes and methods for their fabrication are described in U.S. Pat. No. 4,370,214, issued Jan. 25, 1983, to I. V. Kadija which is incorporated herein in its entirety by reference.

Separators which may be used in electrolytic cells employing the novel method and apparatus of the present invention include porous diaphragms such as those comprised of asbestos fibers or asbestos fibers modified with polymers such as polytetrafluoroethylene, polyvinylidene fluoride, polyacrylic acid, or perfluorosulfonic acid resins. However, preferred as separators are ion exchange membranes.

Cation exchange membranes, which can be employed are inert, flexible membranes, which are substantially impervious to the hydrodynamic flow of the electrolyte and the passage of gas products produced in the cell. Suitably used, for example, are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid group" are meant to include salts of sulfonic acid or salts of carboxylic acid groups by processes such as hydrolysis. Suitable cation exchange membranes are sold commercially by E. I. DuPont de Nemours and Company under the trademark "Nafion"; by the Asahi Glass Company under the trademark "Flemion"; and by the Asahi Chemical Company under the trademark "Aciplex".

The novel method and apparatus of the present invention are illustrated in the following EXAMPLES without any intention of being limited thereby.

EXAMPLE 1

An electrolytic cell for the electrolysis of sodium chloride brine was operated with a titanium anode coated with a catalytically active mixture of $RuO_2$ and $TiO_2$ and a cathode having a Raney Ni-Mo catalytic coating in contact with a cation exchange membrane. The cell was operated to produce chlorine gas, hydrogen gas and NaOH by feeding concentrated aqueous sodium chloride brine and water to the cell. The anolyte was 200 g/l NaCl and a 35 percent aqueous sodium hydroxide solution was produced as the catholyte. The operating current density was 3.0 $KA/m^2$ and the cell temperature was 90° C. Connected to the cathode and the cathode bus bar was a cell protection switch of the type illustrated in the FIGURE. The cell was shut down by gradually reducing the current fed through the cell until the current density was about 0.2 $KA/m^2$.

At this point, the cell protection switch was opened and current fed to the cell was reduced to zero. The cell voltage before shutdown was 2.842 volts and the cathode voltage measured 0.097 volts (Palladium hydride reference electrode). After a period of 2 hours, the cell was restarted by setting the current to a current density of about 0.2 KA/m$^2$; at this point the cell protection switch was closed and the current was increased to the operating current density of 3.0 KA/m$^2$. After startup, the cell voltage was measured at 2.841 volts, a decrease of 0.001 volts below the original operating voltage; and the cathode voltage was 0.105 volts.

COMPARATIVE EXAMPLE A

The identical cell of EXAMPLE 1 was operated in the same manner to produce chlorine, hydrogen and sodium hydroxide solution at a current density of 3.0 KA per square meter and a temperature of 90°. The cell was shutdown by shorting the anode to the cathode, however, without employing the cell protection switch. The cell voltage prior to shutdown was 2.868 volts and the cathode voltage was 0.165 volts. After a shutdown period of several hours, the cell was restarted and operated at a current density of 3.0 KA per square meter. The cell voltage after startup was measured at 2.923 volts, an increase of 0.055 volts over the cell voltage before shutdown; the cathode voltage had increased to 0.224 volts, a gain of 0.059 volts.

EXAMPLE 1 employing the novel method and apparatus of the present invention showed no loss in cathode activity upon cell shutdown and restarting. In contrast, using the apparatus and method of COMPARATIVE EXAMPLE A, the cathode suffered a significant loss of activity as shown by the increase in the cathode voltage of 0.059 volts following cell shutdown and startup.

EXAMPLE 2

The cell of EXAMPLE 1 was shutdown a second time by opening the cell protection switch when the current density had reached 0.2 KA per m$^2$. Upon starting up of the cell using the procedure of EXAMPLE 1, changes in cell voltage and cathode voltage fell within the limits of standard deviation where the cell voltage decreased 0.014 volts and the cathode voltage remained identical to that before shutdown. EXAMPLE 2 shows that the apparatus and method of the present invention prevents activity loss in the cathodes following repeated cell shutdowns and startups.

COMPARATIVE EXAMPLE B

The cell of EXAMPLE 2 was shutdown by electrically shorting the current from the anode to the cathode. Upon restart of the cell 1 hour later, the cell voltage, and the cathode voltage each gained approximately 0.035 volts.

COMPARATIVE EXAMPLE C

The cell of COMPARATIVE EXAMPLE B was shutdown by electrically shorting the current from the anode to the cathode a second time. When the cell was restarted several hours later, the cell voltage and the cathode voltage had each increased by approximately 0.045 volts. This voltage gain was in addition to the voltage gain of COMPARATIVE EXAMPLE B.

EXAMPLE 4

The cell of EXAMPLE 1 was operated with a cathode having a catalytic coating of a co-deposited layer of Raney nickel grains. Using the method of EXAMPLE 1, the cell was operated at a current density of 3.0 KA per square meter. The cell was shutdown by employing the cell protection switch and method of the present invention. When the cell was restarted, the cell voltage had increased by 0.017 volts and the cathode voltage by 0.009 volts.

COMPARATIVE EXAMPLE D

The of EXAMPLE 4 was operated using the procedure of EXAMPLE 4 at a current density of 3.0 KA per square meter. The cell was shutdown by shorting current from the anode to cathode. Upon restarting of the cell, the cell voltage had increased by 0.036 volts and the cathode voltage by 0.050 volts.

EXAMPLE 5

An electrolytic membrane cell having as its anode titanium coated with a catalytically active mixture of ruthenium oxide and titanium dioxide was placed in contact with an ion exchange membrane having carboxylic acid as functional groups. A cathode having as the catalytic coating a Raney nickel-molybdenum alloy was also placed in contact with the membrane. Concentrated sodium chloride brine was fed to the anode compartment to maintain the anolyte at a concentration of approximately 200 grams per liter of NaCl. The cell was operated at a current density of 3.0 KA per square meter and a temperature of 90° C. to produce a caustic soda solution having a concentration of 35 percent by weight NaOH. The cell was operated for 3 months. During this time, the cell was shut down 4 times using a cell protection switch of the type illustrated in the FIGURE. After restarting the cell, neither the cell voltage nor the cathode voltage were increased employing the shutdown procedure of present invention.

What is claimed is:

1. A method for shutting down an electrolytic cell for the electrolysis of aqeueous solutions containing ionizable compounds, said electrolytic cell having a first electrode, a second electrode of opposite polarity, a first conductor electrically connected to the first electrode and a second conductor electrically connected to the second electrode, means for supplying an electric current to the first and second conductors, characterized by the method improvement which comprises reducing said electric current to any suitable level down to that which is slightly above that employed at a reversible potential, activating a cell protection circuit to open the cell between the first conductor and the first electrode during cell shutdown, without maintaining a residual current, to prevent the passage of reverse current through the cell.

2. The method of claim 1 in which the current is reduced by shunting the current from said first conductor to said second conductor.

3. The method of claim 2 in which said ionizable compounds are selected from the group consisting of alkali metal chlorides, alkali metal bromides, and alkali metal hydroxides.

4. An electrolytic cell having a cell body comprised of a first electrode, a second electrode of opposite polarity, a first conductor connected to a first electrode, a second conductor connected to a second electrode, said first electrode having a low overvoltage, characterized by the improvement which comprises a cell protection switch connecting said first conductor and said first electrode, said cell protection switch adapted to open the cell circuit during cell shutdown to prevent the passage of reverse current.

5. The electrolytic cell of claim 4 in which the cell protecting switch is selected from the group consisting of single pole switches, double pole switches and multiple pole switches.

6. The electrolytic cell of claim 5 in which the first electrode is a cathode having a low hydrogen overvoltage catalytic coating comprised of a Raney metal selected from the group consisting of nickel, cobalt, and alloys thereof.

7. The electrolytic cell of claim 5 in which the first electrode is an anode having a low chlorine overvoltage coating comprised of a platinum group metal or a platinum group metal oxide.

8. The electrolytic cell of claim 5 in which a shunting switch is connected to said first conductor and said second conductor to reduce electric current fed to the electrolytic cell.

9. The electrolytic cell of claim 8 in which the shunting switch is portable.

10. The electrolytic cell of claim 8 in which a separator is positioned between said first electrode and said second electrode.

11. The electrolytic cell of claim 10 in which said separator is an ion exchange membrane.

12. The electrolytic cell of claim 11 in which said ion exchange membrane is a cation exchange membrane.

13. In a method for shutting down a plurality of electrolytic cells in series for the electrolysis of aqueous solutions containing ionizable compounds; each electrolytic cell having a first electrode, a second electrode of opposite polarity, a first conductor electrically connected to the first electrode and a second conductor electrically connected to the second electrode, means for supplying an electric current to the first and second conductors, characterized by the method improvement which comprises activating a cell protection circuit to open the cell circuit between the first conductor and the first electrode of one electrolytic cell in said series during cell shutdown, without maintaining a residual current, to prevent the passage of reverse currents through said plurality of electrolytic cells.

14. A method for operating an electrolytic cell for the electrolysis of aqueous solutions containing ionizable compounds which comprises:

(a) feeding electric current to first conductor;
(b) closing a cell protection circuit connecting said first conductor and an anode;
(c) conducting current from said first conductor through said cell protection circuit to said anode;
(d) contacting said anode with said aqueous solution of an ionizable compound;
(e) passing electric current from said anode through said aqueous solutions to a cathode at a voltage substantially greater than the reversible potential to electrolyze said ionizable compound;
(f) separating said anode from said cathode with an ion exchange membrane;
(g) reducing said electric current to any suitable level down to that which is slightly above that employed at a reversible potential;
(h) opening said cell protection circuit; and
(i) discontinuing said electrolysis without maintaining a residual current.

15. The method of claim 14 in which prior to step (g), electric current at a voltage slightly above said reversible potential is fed through said cell protection switch.

16. An electrolytic cell circuit comprised of a plurality of electrolytic cells in series, each electrolytic cell comprising a low hydrogen over voltage cathode, an anode, a first conductor electrically connected to said cathode, a second conductor connected to said anode, an ion exchange membrane separating said anode from said cathode, means for supplying electric current to said first conductor and said second conductor, and a cell protection switch connected between said first conductor and said cathode adapted to open the cell circuit to prevent the passage of reverse current between the cathode and the anode.

* * * * *